US012402672B2

(12) United States Patent
Zhang et al.

(10) Patent No.: US 12,402,672 B2
(45) Date of Patent: Sep. 2, 2025

(54) REUSABLE PROTECTIVE CLOTHING

(71) Applicant: XIAMEN UNIVERSITY, Xiamen (CN)

(72) Inventors: Lei Zhang, Xiamen (CN); Yuzhang Shao, Xiamen (CN); Dean Zhao, Xiamen (CN); Ye Li, Xiamen (CN); Leji Wen, Xiamen (CN); Xin Lin, Xiamen (CN)

(73) Assignee: XIAMEN UNIVERSITY, Xiamen (CN)

( * ) Notice: Subject to any disclaimer, the term of this patent is extended or adjusted under 35 U.S.C. 154(b) by 46 days.

(21) Appl. No.: 18/063,046

(22) Filed: Dec. 7, 2022

(65) Prior Publication Data

US 2024/0130448 A1 Apr. 25, 2024
US 2024/0237763 A9 Jul. 18, 2024

(30) Foreign Application Priority Data

Oct. 19, 2022 (CN) ..... 202211279309.X

(51) Int. Cl.
*A41D 13/02* (2006.01)
*A41D 13/11* (2006.01)

(52) U.S. Cl.
CPC ..... *A41D 13/02* (2013.01); *A41D 13/1184* (2013.01); *A41D 2200/20* (2013.01)

(58) Field of Classification Search
CPC ..... A41D 13/02; A41D 13/1184; A41D 13/1218; A41D 13/1161; A31D 2200/20; A31D 2500/20; A62B 17/006
See application file for complete search history.

(56) References Cited

U.S. PATENT DOCUMENTS 4,253,198 A * 3/1981 Estabrook ..... B63C 9/087 2/84
4,845,779 A * 7/1989 Wheeler ..... A42B 1/046 2/84

(Continued)

OTHER PUBLICATIONS

"Nanomaterial sticky tape that withstands extreme temperatures", Laurie Donaldson, Materials Today, Jul. 30, 2019, accessed from https://www.materialstoday.com/nanomaterials/news/nanomaterial-sticky-tape-extreme-temperatures/ (Year: 2019).*

*Primary Examiner* — Patrick J. Lynch
*Assistant Examiner* — Brianna T. Duckworth
(74) *Attorney, Agent, or Firm* — JEEN IP LAW, LLC

(57) ABSTRACT

A reusable protective clothing includes a one-piece protective suit which includes integrated top and trousers attached with gloves and shoe covers, and a protective headpiece having a face shield. A front side of the protective headpiece is provided with a full-vision goggle with 180-degree field of view, the full-vision goggle is integrated with the face shield, a back side of the protective headpiece is provided with a protective hood made of a material of the one-piece protective suit, the protective hood is integrated with the top, the front side of the protective headpiece is provided with an air vent for a mouth and a nose configured according to facial features of a wearer, and an outer side of the protective headpiece is provided with ear-shaped hooks. The protective clothing is designed according to application environment and medical requirements to prevent exposure to pathogenic microorganisms.

7 Claims, 7 Drawing Sheets

(56) References Cited

U.S. PATENT DOCUMENTS

| | | | | |
|---|---|---|---|---|
| 5,918,314 | A * | 7/1999 | Moses | A41D 13/02 2/84 |
| 11,202,925 | B1 * | 12/2021 | Awad | A62B 7/10 |
| 2005/0204451 | A1 * | 9/2005 | Plut | A41D 19/0055 2/161.6 |
| 2015/0113716 | A1 * | 4/2015 | Samaniego | A42B 1/048 2/457 |
| 2021/0267292 | A1 * | 9/2021 | Wang | A41D 13/12 |
| 2021/0298368 | A1 * | 9/2021 | Bussey | A47C 31/003 |
| 2022/0110387 | A1 * | 4/2022 | Dettorre | A41D 13/1184 |
| 2022/0160059 | A1 * | 5/2022 | Arangdad | A41D 31/10 |

* cited by examiner

REUSABLE PROTECTIVE CLOTHING

CROSS-REFERENCE TO RELATED APPLICATIONS

This application is based upon and claims priority to Chinese Patent Application No. 202211279309.X, filed on Oct. 19, 2022, the entire content of which is incorporated herein by reference.

TECHNICAL FIELD

The present disclosure relates to the technical field of protective clothing, particularly to a reusable protective clothing.

BACKGROUND

At present, the majority of protective clothing consumed globally is disposable protective clothing, which has the following drawbacks: (1) Substantial environmental pollution: the extensive use of disposable protective clothing requires high disposal costs and causes substantial environmental pollution. (2) Poor physical strength: the currently available disposable protective clothing has poor mechanical properties and tends to be easily torn by an external force, thus it cannot provide adequate protection. Most of the reusable protective clothing developed worldwide use polytetrafluoroethylene (PTFE) film with micropores or PTFE composite film to form a barrier layer. In order to improve the laundering durability, a thick barrier film is preferred, which also has the following drawbacks. (1) The protective clothing needs to be supplemented with goggles, a face shield, a mask, gloves, and shoe covers for full body protection, and therefore cannot be put on or taken off as a whole. (2) Uncomfortable to wear: its key barrier layer features poor moisture permeability and can impair visual field and voice transmission. (3) Lifespan, namely the number of repeated use, of the protective clothing is very limited. (4) There is no differentiation between its use in the medical field and epidemic prevention.

Currently, due to the continuous waves of the pandemic, as well as the increase in awareness of disease prevention and volunteering, more and more people participate in disease prevention and control. The reusable protective clothing of the present disclosure is specially designed for disease prevention personnel and indoor medical staff. On the one hand, the reusable protective clothing can reduce medical waste and save social resources. On the other hand, the reusable protective clothing can reduce the number of steps for personnel to put on and take off the protective clothing, so as to maximize the protection for non-professionals against exposure to pathogens caused by operational mistakes. In addition, auxiliary functions are added to the reusable protective clothing in consideration of the specific requirements of disease prevention personnel and medical staff.

SUMMARY

The present disclosure provides a reusable protective clothing which can effectively address the above problems.

The present disclosure provides a reusable protective clothing material including a high-density woven fabric layer, a middle-layer fabric and an outer-layer fabric.

A reusable protective clothing is made of the reusable protective clothing material.

The reusable protective clothing is a one-piece protective suit including integrated top and trousers attached with gloves and shoe covers, and further including a protective headpiece having a face shield, wherein a front side of the protective headpiece is provided with a pair of full-vision goggles with 180-degree field of view, the pair of full-vision goggles is integrated with the face shield, a back side of the protective headpiece is provided with a protective hood made of a material of the one-piece protective suit, the protective hood is integrated with the top, the front side of the protective headpiece is also provided with an air vent for a mouth and a nose configured according to facial features of a wearer, and an outer side of the protective headpiece is provided with ear-shaped hooks.

As a further improvement, the air vent for the mouth and the nose is arranged on the protective headpiece at a position corresponding to the mouth and a bridge of the nose of the wearer, and an edge of the air vent is provided with a sealing ring for fixing a filter membrane.

As a further improvement, an elastic belt is arranged along an edge around an outer contour of the filter membrane.

As a further improvement, the protective headpiece further includes a latex band arranged on two sides of the air vent for the mouth and the nose, and the latex band is arranged inside the protective headpiece to assist the positioning of the air vent for the mouth and the nose.

As a further improvement, the protective headpiece further includes a support ring arranged at a top part of the protective headpiece.

As a further improvement, the support ring is a semicircular silicone ring with a thickness of 3 cm.

As a further improvement, the top includes a back body covering piece and a front body covering piece, the protective hood is connected to a neck position of the back body covering piece and extends to the top part of the protective headpiece, and a first end of a waterproof zipper is arranged at a hip position at a back side of the trousers, a second end of the waterproof zipper extends through the back body covering piece to the top of the protective hood, and the waterproof zipper is covered with a flap.

As a further improvement, the gloves are full-finger wear-resistant anti-slip gloves.

As a further improvement, the gloves are half-finger gloves, and a wrist position of each half-finger glove is provided with nano tape.

As a further improvement, the trousers further include wear-resistant and anti-slip shoe covers provided at bottom positions of trouser legs.

The present disclosure has the following advantages. The present disclosure provides a reusable one-piece protective clothing designed according to the needs of epidemic prevention personnel and volunteers, and provides a medical protective clothing designed according to the needs of medical personnel. The protective clothing is a one-piece protective suit that is designed according to the environment and medical requirements and can maximize prevention against exposure to pathogenic microorganisms during wearing, taking-off and using process. The term "one-piece" reflects in the design that only the nose and the mouth are accessible from the outside, and the rest parts of the body are fully enclosed as a closed loop. The protective clothing is lightweight and requires no additional auxiliary device or means. Also, the protective clothing is able to be put on and taken off as a whole and thus the putting-on and taking-off can both be accomplished by a single act.

The medical protective clothing and the reusable one-piece protective clothing both have a protective headpiece with a face shield. Namely, the front side of the protective headpiece is a 180-degree fully transparent head cover made of glass fibre-reinforced plastic material, and the back side of the protective headpiece is a protective hood made of the material of the protective clothing. This design not only increases the field of view, but also minimizes hearing loss by air transmission, it has better performance than the design of the head covers of known protective clothing on the market and is easier to use.

The filter membrane is specially designed for the mouth and the nose, and thus a conventional face mask may not be worn, thereby reducing the strain on the ears. Meanwhile, the filter membrane for the mouth and the nose serves as an access for ventilation of the protective headpiece as well as providing protection for the wearer, which is favorable for permeation of exhaled moisture, and reducing moisture vapor inside the protective headpiece. Furthermore, ear-shaped hooks are provided on an outer side of the protective headpiece, so that an additional mask may be worn on the hooks in special settings to provide dual-layer protection for the respiratory tract.

The present disclosure is configurable with full-finger wear-resistant anti-slip gloves or half-finger gloves according to practical requirements. For example, half-finger gloves may be used indoors, and the fingers are covered with medical rubber gloves, so as to improve the flexibility of the fingers and allow the medical personnel to do some fine finger movements and operations. Alternatively, the full-finger wear-resistant anti-slip gloves may be used outdoors or in some special settings. The fully enclosed design provides a higher protection level. Furthermore, friction particles provided on the gloves offer increased friction to prevent items from slipping off the wearer's grip.

According to the work practices of the epidemic prevention personnel and volunteers, the elbow and knee positions of the protective clothing are provided with reflective fabric pieces to improve the wear resistance of the quick-wearing parts and to increase the safety factor of outdoor work at night.

The material of the reusable protective clothing can withstand immersion in chlorine-containing disinfectant with a concentration of 1000 mg/l for 60 minutes, and more than 50 times of disinfection. The material of the one-piece medical protective clothing can withstand moist heat sterilization under a temperature of 115° C.-121° C. for 15 min-30 min, and more than 50 times of moist heat sterilization, thereby permitting the reuse of the protective clothing several times and reducing the generation of medical waste.

BRIEF DESCRIPTION OF THE DRAWINGS

In order to make the technical solutions of the embodiments of the present disclosure clearer, the drawings used to illustrate the embodiments will be briefly introduced below. It should be understood that the following drawings merely show some embodiments of the present disclosure, and therefore should not be regarded as restriction to the scope of protection. For those of ordinary skill in the art, other related drawings may be derived based on these drawings without any creative effort.

DETAILED DESCRIPTION OF THE EMBODIMENTS

Figure 1:
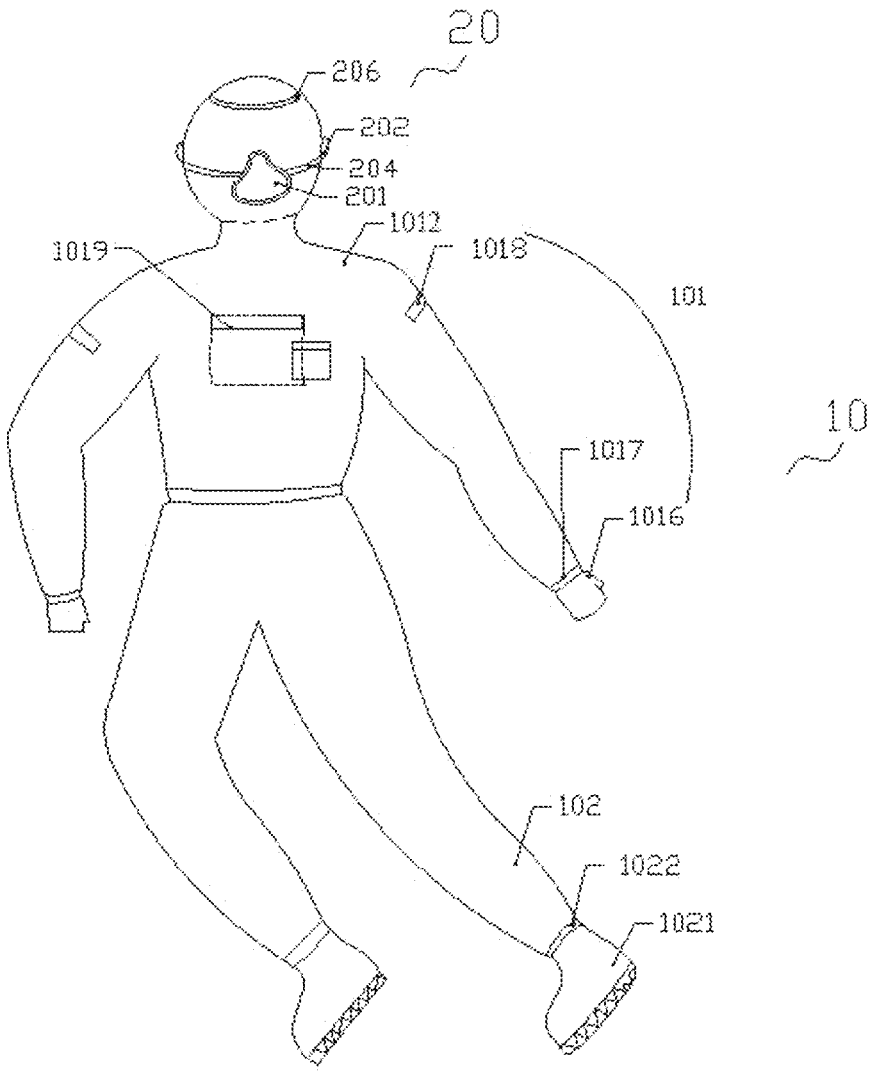
FIG. 1 is a schematic diagram showing a front side of a reusable protective clothing according to a first embodiment of the present disclosure.

In order to make the objectives, technical solutions, and advantages of the embodiments of the present disclosure clearer, the technical solutions of the embodiments of the present disclosure will be described clearly and completely below in combination of the drawings used to illustrate the embodiments of the present disclosure. Obviously, the described embodiments are parts of rather than all of the embodiments of the present disclosure. Based on the embodiments of the present disclosure, all other embodiments derived by those of ordinary skills in the art without creative effort fall within the scope of protection of the present disclosure. Accordingly, the following detailed description of the embodiments of the present disclosure shown in the drawings is not intended to limit the scope of protection of the present disclosure, but merely to represent selected embodiments of the present disclosure.

In the description of the present disclosure, the terms "first", "second" are used only for descriptive purposes and cannot be understood as indicating or implying relative importance or implying the number of indicated technical features. Thus, a characteristic that is referred to by "first" and "second" may include, expressly or implicitly, one or more of the characteristics. In the description of the present disclosure, "multiple/several/couple" means two or more, unless otherwise expressly specified.

Embodiment 1

Referring to FIGS. 1-7, the present embodiment provides a specific application of the reusable protective clothing, i.e. medical protective clothing, which is used indoors or at some places with relatively flat ground, such as hospitals, clinics, etc., and is mainly involved in indoor activities, such as medical treatment activities, which requires fine finger movements and operations. The protective clothing is mainly used to protect the wearer against all pathogenic microorganisms such as viruses, bacteria, rickettsia, and so on from internal and external environments. The medical protective clothing mainly includes a one-piece protective suit 10 and a protective headpiece 20 having a face shield 11.

The one-piece protective suit 10 includes integrated top 101 and trousers 102, and the top 101 and trousers 102 are respectively attached with gloves and shoe covers. In practice, the wearer may put on the one-piece protective suit 10 by: first wearing the trousers 102, then wearing the top 101, afterwards wearing the protective headpiece 20 with the face shield 11, and finally pulling up the waterproof zipper 1014 with the help of another individual to seal the protective suit. The specific steps and principles are described as follows.

S1, wearing the trousers 102.

Figure 2:
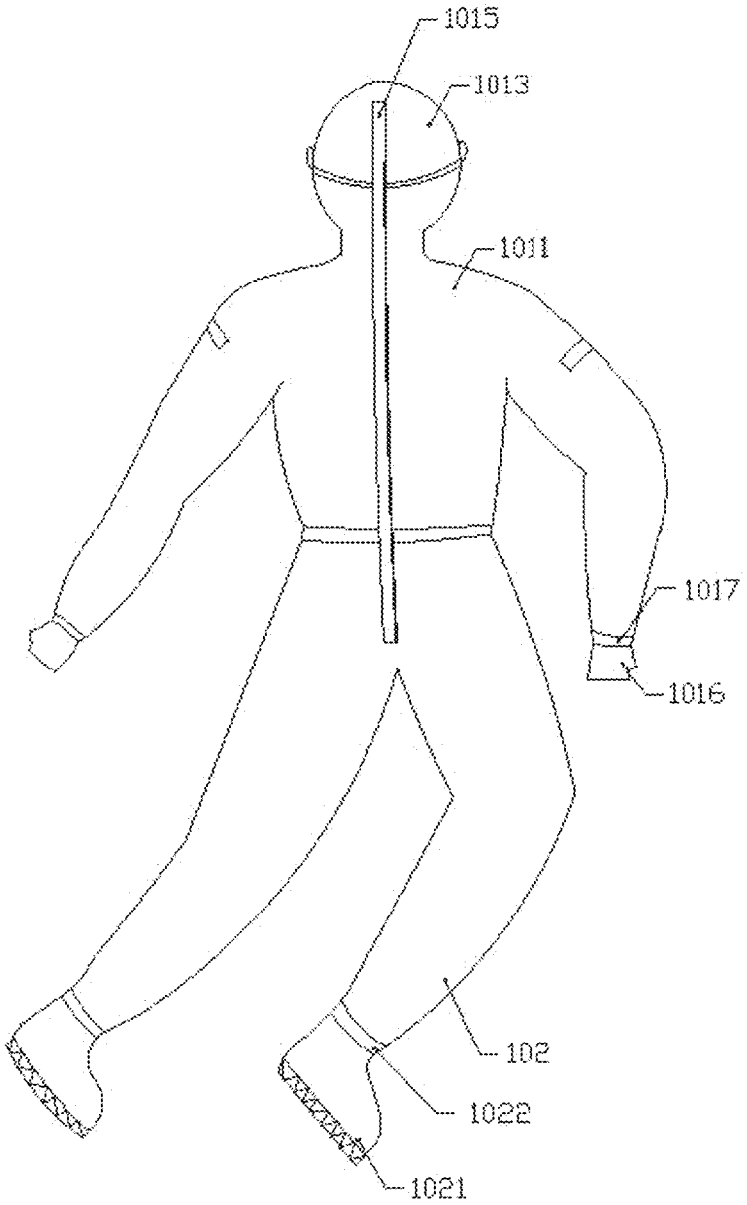
FIG. 2 is a schematic diagram showing a back side of a reusable protective clothing according to the first embodiment of the present disclosure.
Figure 3:
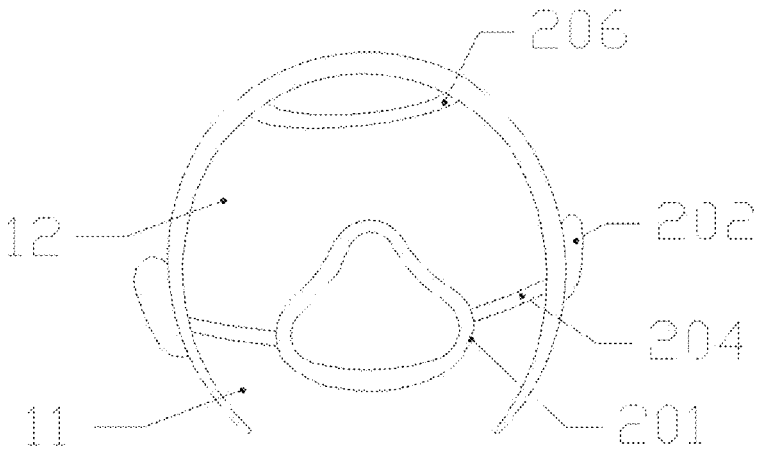
FIG. 3 is a schematic diagram showing a front side of a protective headpiece having a face shield of the reusable protective clothing according to an embodiment of the present disclosure.
Figure 4:
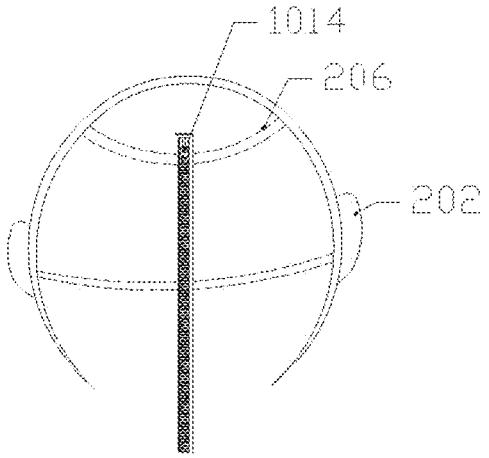
FIG. 4 is a schematic diagram showing a back side of a protective headpiece having the face shield of the reusable protective clothing according to an embodiment of the present disclosure.

As shown in FIG. 1 and FIG. 2, the trousers 102 of the present disclosure further include wear-resistant and anti-slip shoe covers 1021 connected to the bottom of the trouser legs. The soles of the shoe covers of the known protective clothing are also made of the same material as the top 101 and the trousers 102, so the soles may easily be damaged. According to the present disclosure, instead of being made of the material of the protective clothing, the wear-resistant and anti-slip shoe covers 1021 are made of another material to increase the thickness of the bottom, so as to allow medical staff to wear the shoe covers with their own shoes on while the wear-resistant and anti-slip shoe covers 1021 are unlikely to be damaged during walking.

The wear-resistant and anti-slip shoe covers 1021 of the present disclosure are made of rubber material which has many advantages including good wear resistance, anti-slip performance, elasticity, anti-break strength, suppleness, extensibility, stable shrinkage, hardness, flexibility and so on. These advantages allow the shoe covers to withstand repeated sterilization and repeated use in practice.

Further, the thickness of the sole of the wear-resistant and anti-slip shoe cover 1021 is 1-2 cm.

In one specific embodiment, the thickness of the sole of the wear-resistant and anti-slip shoe cover 1021 is 1.5 cm which ensures that the wear-resistant and anti-slip shoe cover 1021 will not be damaged by walking while the sole is light-weight and not too thick to affect the comfort degree of walking. The thickness of the sole plus the thickness of the wear-resistant and non-slip shoe cover 1021 is smaller than or equals to 3 cm.

Further, the sole of the wear-resistant and anti-slip shoe cover 1021 is provided with friction patterns which include but not limited to wavy patterns. In indoor settings such as hospitals etc., the floor is frequently mopped and washed in these places as required by medical standards, so the ground is often wet and slippery. The design of the friction pattern on the bottom side of the sole increases friction between the said bottom side and the ground, so the wearer is unlikely to slip and fall off during walk.

In one specific embodiment, the friction pattern is wavy-shaped with a depth of 0.1-0.5 cm. The friction pattern being a wavy pattern with a depth of 0.15 cm can achieve an optimal friction resistance with the ground, and the pattern is unlikely to be substantially worn in a single use even after prolonged walking, so as to achieve repeated use.

In one specific embodiment, the friction pattern is circular-shaped with a depth of 0.15-0.4 cm. The friction pattern being circular-shaped with a depth of 0.2 m and a diameter of 2.5 cm can achieve an optimal friction resistance with the ground, and the pattern is unlikely to be substantially worn in a single use after prolonged walking, so as to achieve the effect of repeated use.

As a further improvement, positions of the ankle of the wear-resistant and anti-slip shoe cover 1021, the wrist position, and waist position are provided with hook and loop fasteners 1022 for fastening and fixing the protective clothing.

S2, wearing the top 101.

As shown in FIG. 1 and FIG. 2, a pair of medical rubber gloves can be put on the wearer's hands before putting on the top 101, and after the top 101 is put on another pair of medical rubber gloves are put on the wearer's hands.

The top 101 includes a back body covering piece 1011 and a front body covering piece 1012, a protective hood 1013 is connected to a neck position of the back body covering piece 1011 and extends to the top part of the protective headpiece 20, and a first end of a waterproof zipper 1014 is arranged at a hip position at a back side of the trousers 102, a second end of the waterproof zipper 1014 extends through the back body covering piece 1011 to the top of the protective hood 20, and the waterproof zipper 1014 is covered with a flap 1015.

As shown in FIG. 1 and FIG. 2, the gloves are half-finger gloves 1016. After wearing the half-finger gloves 1016, a pair of medical rubber gloves are put on. The half-finger gloves 1016 allow the fingers to move flexibly for conducting fine finger movements and operations, such as operating surgical instruments and so on. Since the fabric material of the one-piece protective suit 10 is relatively rough and stiff, the use of half-finger gloves 1016 can maximize the flexibility of the fingers and improve the sealability of the medical protective clothing. Since medical rubber gloves are worn before and after wearing the protective clothing, two layers of medical rubber gloves ensure that even if the outer layer of medical rubber gloves is taken off after use, the air tightness of the protective clothing will not be affected, and the inner layer of medical rubber gloves will not be contaminated, so as to achieve the purpose of repeated use.

As shown in FIG. 1 and FIG. 2, a nano-tape 1017 is provided at the wrist position of the half-finger gloves 1016. The nano-tape 1017 is used to fix the rim of the medical rubber gloves to the wrist position of the medical protective clothing. Further, if the damage of the protective clothing is discovered during use, the nano-tape 1017 can be used to patch the tear to temporarily repair the protective clothing.

The nano-tape 1017 is made of nano-adhesive material and can withstand multiple times of washing. When the adhesive surface of the nano-tape is contaminated by dust or other dirt, the nano-tape can be washed with clean water and dried while retaining its original adhesiveness. Also, the nano-tape is removable without leaving any residue, so it can be applied for attachment and removed repeatedly without leaving any residue on the surface of objects.

Further, the width of the nano-tape 1017 is 4-6 cm. In one specific embodiment, the width of the nano-tape 1017 is 5 cm, which is an optimal width because, given the limited length usually used for patching, the tape will not get folded up transversely onto itself during use, so the nano-tape is simpler and more convenient for use.

Further, a pocket is provided at the position of the chest on the front body covering piece 1012, and nano-tape 1017 is placed in the pocket as a backup.

As a further improvement, the upper arm position of the top 101 is provided with an armband attachment 1018 for attaching an identification tag of the wearer, and the identity information carried on the identification tag includes but not limited to the serial number and name, so as to facilitate the identification of the medical staff.

As a further improvement, absorbent bags 1019 may be provided and fixed at multiple places, such as the center position of the chest on the front body covering piece 1012, the center position of the back, and the underarm positions, by means of hook and loop. The absorbent bags 1019 can absorb the moisture from corresponding locations covered by the one-piece protective suit 10. For example, the absorbent bag 1019 is arranged at the center of the chest where body fluid is most likely to be produced from the surface of the wearer's body and along which body fluid from the neck flows down, such that the body fluid can be directly absorbed by the absorbent bag 1019. Since the absorbent bag 1019 is detachable, the absorbent bag 1019 can be removed before disinfection and sterilization.

Furthermore, one or more hook and loop fasteners may be arranged between the absorbent bags 1019 and the inner wall of the protective clothing according to the body shape of the wearer or other factors. Compared with the configuration of one hook and loop fastener, multiple loop and hook fasteners provided at different connection points enable the absorbent bags 1019 to be attached more securely, and can prevent detachment of the heavier absorbent bag 1019 after absorbing body fluid.

In practice, compared with directly wearing the protective clothing, placing the absorbing bag 1019 can improve the comfortableness of the protective clothing as the absorbent bag 1019 can absorb body fluid produced by wearing the protective clothing under static or dynamic working conditions.

Preferably, $CaCl_2$ may be placed in the absorbent bag 1019. Compared with other ordinary materials, the absorbent bag 1019 with $CaCl_2$ has better absorbing performance.

More preferably, molecular sieve may be placed in the absorbing bag 1019. Compared with $CaCl_2$, molecular sieve further improves the absorbing performance of the absorbing bag 1019.

S3, wearing a protective headpiece 20 having a face shield 11.

With reference to FIG. 3-FIG. 7, the present disclosure further includes a protective headpiece 20 having a face shield 11. The front side of the protective headpiece 20 is provided with a pair of 180-degree full-vision goggles 12 which is integrated with the face shield 11. The back side of the protective headpiece 20 is provided with a protective hood 1013 made of protective clothing material, and the protective hood 1013 is integrated with the top 101. The front side of the protective headpiece 20 is provided with an air vent 201 for the mouth and the nose corresponding to the facial features of the wearer. Compared with the prior art in which only a pair of goggles is used for viewing in a limited visual angle, the present disclosure enables the wearer to view in a wider visual angle and is more practical to use. Here, the connection method of the protective headpiece 20 and the protective hood 1013 includes but not limited to press fit, sheathing, etc., and the protective headpiece 20 can be removed and repeatedly used in other protective clothing.

Figure 5:
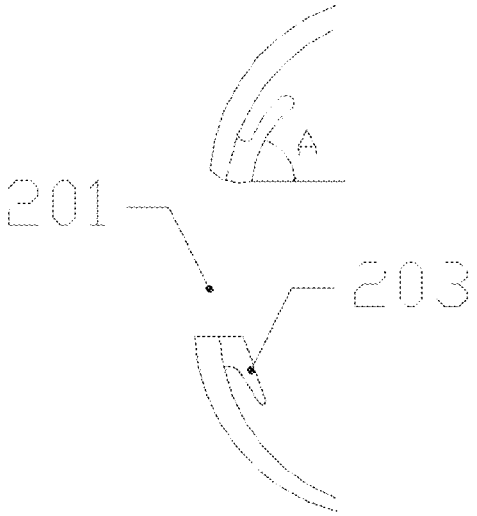
FIG. 5 is a schematic diagram showing a structure of an air vent for the mouth and the nose of the protective headpiece having the face shield of the reusable protective clothing according to an embodiment of the present disclosure.
Figure 6:
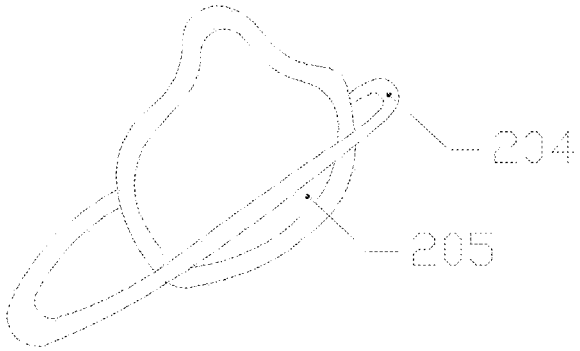
FIG. 6 is a schematic diagram showing a structure of a filter membrane for the mouth and the nose of the reusable protective clothing according to an embodiment of the present disclosure.

As shown in FIG. 5, the protective headpiece 20 is provided with a silicone sealing ring 203 at the edge of the air vent 201 for the mouth and the nose corresponding to the mouth and bridge of the nose of the wearer. The use of flexible material such as silicone can ensure a better fit with the shape of the wearer's face without leaving a gap, thereby improving the air tightness of the medical protective clothing.

Further, a U-shaped groove is formed between the sealing ring 203 and the inner wall of the protective headpiece 20, and the filter membrane 205 for the mouth and the nose is fixed at the U-shaped groove with the assistance of a latex band 204, so as to eliminate the need of a mask, and thus reduces the strain on ears. The use of the special filter membrane for the mouth and the nose is favorable for discharging moisture vapor from the wearer's respiratory tract, and the specific principle is described as follows. Compared with the completely enclosed protective headpiece with a face shield in the prior art, since there is a temperature difference between the air exhaled from the respiratory tract and the protective headpiece, the moisture vapor tends to condense into water droplets on the protective headpiece. Epidemic prevention and medical staffs who work in this environment for a prolonged period get sweaty easily, leaving their body and clothes wet. According to the present disclosure, filter membrane 205 is used as an access to connect the inside and outside of the protective headpiece 20 for protection and ventilation, thereby further reducing moisture generation in the protective headpiece 20.

Further, the thickness of the side of the sealing ring 203 in contact with the inner wall of the protective headpiece 20 is greater than that of the opposite side. The side of the sealing ring has a lower thickness which enables it to better fit with the wearer's face and is unlikely to detach therefrom.

Further, the sealing ring 203 forms an angle with the horizontal plane, and the angle ranges 90°-150°. In one specific embodiment, the angle between the sealing ring 203 and the horizontal plane is 100°. With a relatively smaller tilt angle, the sealing ring 203 can be easily attached in place with wearer's mouth and nose without the need for repeated adjustments, and thus the air vent 201 can be directly aligned with the facial features as the sealing ring is attached to the wearer's face.

Further, the structure of the filter membrane 205 for the mouth and the nose shown here includes two layers of fibrous non-woven fabrics for professional medical and health care use and a middle layer between the two layers. The middle layer is made of filter melt-blown fabric which can filter and prevent passage of more than 99% of bacteria. The middle layer and the other two layers are combined by ultrasonic welding.

Figure 7:
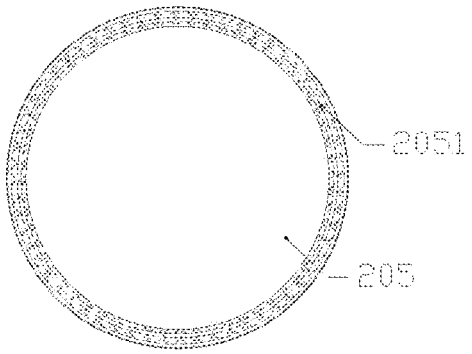
FIG. 7 is another schematic diagram showing a structure of a filter membrane for the mouth and the nose of the reusable protective clothing according to an embodiment of the present disclosure.

As shown in FIG. 7, further, an elastic belt 2051 is arranged along an edge around an outer contour of the filter membrane 205 for the mouth and the nose. When fixing the filter membrane 205 on the sealing ring 203, the elastic belt 2051 is adaptable to the shape of the air vent 201 for the mouth and the nose and tightly engaged with the U-shaped groove of the sealing ring 203, so as to prevent any displacement with the movement of the mouth, and further improve the air tightness of the protective clothing. In addition, the filter membrane 205 can be handled as medical waste after use.

The protective headpiece 20 of the present disclosure further includes ear-shaped hooks 202 provided on the outer side of the protective headpiece 20. If enhanced protection for the respiratory tract is required under special circumstances, a mask may be worn on the external ear-shaped hooks 202 to provide a secondary filtration of air and forms a dual-layer protection for the respiratory tract in combination with the filter membrane 205 for the mouth and the nose.

The protective headpiece 20 of the present disclosure further includes a latex band 204 arranged on two sides of the air vent 201, and the latex band 204 is arranged inside the protective headpiece 20 to help the positioning of the air vent 201.

The protective headpiece 20 of the present disclosure further includes a support ring 206 arranged at a top part of the protective headpiece 20 to stably support the head part of the protective headpiece 20, and to retain its shape and avoid deformation.

Further, the support ring 206 is made of a semi-circular silicone ring with a thickness of 3 cm, and the support ring 206 supports the top part of the protective headpiece 20. After the protective headpiece 20 is put on, the inner wall of the protective headpiece 20 is supported and will not attach to the wearer's forehead.

Currently available fully enclosed protective headpiece with a face shield is generally a fully integrated helmet, which completely covers the entire head and can easily cause sound loss. Namely, by using a fully enclosed headpiece, the wearer cannot be heard clearly and the wearer also cannot hear others clearly.

According to the present disclosure, the front side of the protective headpiece 20 is provided with a 180-degree fully transparent head cover made of glass fiber-reinforced plastic, and the back side of the protective headpiece 20 is provided with a protective hood 1013 made of the material of the protective clothing. In order to ensure a barrier-free 180-degree field of view and minimize air transmission loss, hearing comparison tests under different settings are performed during the design of the protective headpiece 20.

First, sound vibrations are transmitted to the auditory center of the brain to create hearing by two types of conduction. One of them is air transmission where sound vibrations are transmitted to the eardrum through external auditory canal, then transmitted to the cochlear hair cells through the ossicular chain to generate electrical signals which are then transmitted to the auditory center along the auditory nerve. Another one is bone conduction, where sound vibrations are transmitted to the cochlear hair cells through the skull bone, and follow the same pathway as the air transmission to be transmitted to the auditory center.

Accordingly, the present disclosure performed sound field tests, the principle is that the hearing of the tested person is determined according to the response of the person to the quietest sound that can be heard. The sound field tests were carried out by the following method. In the same test environment, the brand of audiometer used was OTOMETRICS® and the brand of speaker used was SOUNDLINK®, the hearing of the volunteers was tested in 3 conditions including: baseline hearing of the volunteers themselves in normal situations, hearing after wearing the protective clothing, and hearing after wearing the head cover. The audiometer emits sound waves of different frequencies to be transmitted into the sound field through the speaker, and the volunteers response to whether they hear the sound or not to determine the hearing threshold.

Circumstance of statistical significance $P>0.05$ was not found in the statistical results under normal hearing conditions, which indicates that the overall distribution of the samples is non-skewed, and the data can be regarded as satisfying normality, so paired samples t-test was performed for pairwise comparisons.

When the difference between wearer's own baseline hearing and the wearer's hearing with the protective clothing on under the normal situation is not statistically significant. i.e. $P>0.05$, it can be considered that the protective clothing will not cause hearing loss; when the difference between the wearer's own baseline hearing and the wearer's hearing with the protective head cover on under normal situation is statistically significant, i.e. $P<0.01$, which indicates that the overall distribution of the two samples is different, it can be considered that the protective head cover will cause significant hearing loss; when the difference between the hearing with the protective clothing on and the hearing with the protective head cover on is statistically significant, i.e. $P<0.01$, which indicates that the overall distribution of the two samples is different, it can be considered that the protective head cover will cause significant hearing loss compared with the protective clothing.

TABLE 1

Paired sample test of audiometry under three situations

| | | paired difference | | | | | | | |
|---|---|---|---|---|---|---|---|---|---|
| | | | | standard | Difference 95% confidence interval | | | | |
| | | average value | standard deviation | error mean | lower limit | upper limit | t | degrees of freedom | Sig. Two-tailed |
| pair 1 | Normal-protective clothing | 0.45455 | 3.50325 | 1.05627 | −1.89897 | 2.80806 | 0.430 | 10 | 0.676 |
| pair 2 | Normal-headpiece | −13.29545 | 3.12614 | 0.94257 | −15.39562 | −11.19529 | −14.106 | 10 | 0.000 |
| pair 3 | Protective clothing-headpiece | −13.75000 | 3.06186 | 0.92319 | −15.80699 | −11.69301 | −14.894 | 10 | 0.000 |

To sum up, this experiment determined the level of sound according to the volunteers' response to sound in the three situations to confirm the degree of sound loss of air transmission caused by the protective clothing and head cover. The results showed that the difference between hearing loss with the protective clothing on and hearing loss in the normal state is not statistically significant. While with the protective head cover on, whether compared with the protective clothing test or normal state test, it all shows that hearing loss is significant due to the limited air transmission. Therefore, in order to ensure the barrier-free 180-degree field of view of the protective clothing of the present disclosure, the head cover designed by the present disclosure includes a front part and a back part. The front part is a protective headpiece 20 with a face shield 11 and is made of glass fiber-reinforced plastic material to ensure a full-screen field of view, and the back part of the head cover is made of the protective clothing material to minimize air transmission loss, and the improved head cover of the protective clothing has better performance than those are currently available on the market and is easier to use.

S4, pull up the waterproof zipper 1014 with the help of another person, and put the flap 1015 in place for covering the waterproof zipper 1014, thus the putting-on and taking-off can both be accomplished by a single act.

Embodiment 2

Figure 8:
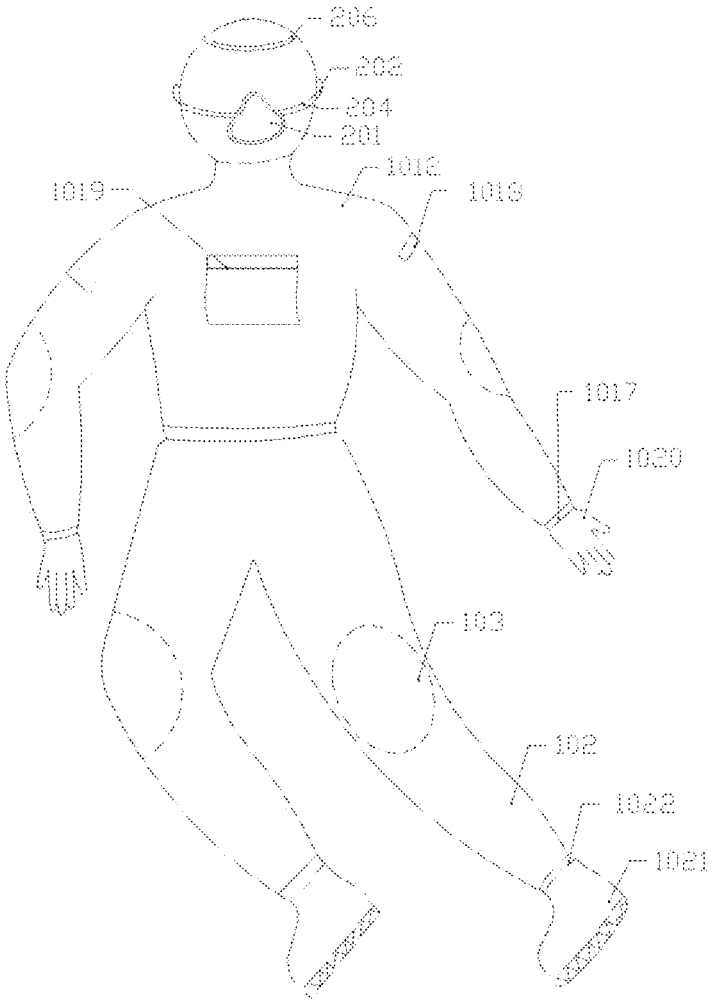
FIG. 8 is a schematic diagram showing a front side of a reusable protective clothing according to a second embodiment of the present disclosure.
Figure 9:
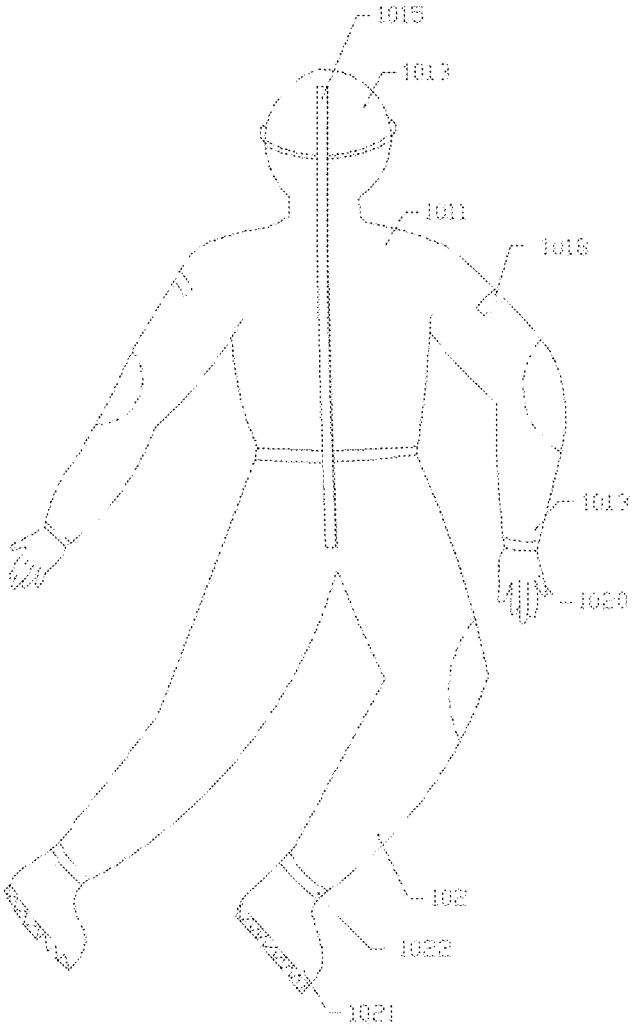
FIG. 9 is a schematic diagram showing a back side of the reusable protective clothing according to a second embodiment of the present disclosure.

As shown in FIGS. 8 and 9, the present embodiment is different from embodiment 1 in that the present embodiment relates to a reusable protective clothing for epidemic prevention, which is mainly worn and used outdoors, including but not limited to forests, urban streets, grasslands, sandy landscapes, etc., where social activities take place and there are labor-intensive operations, the object to be prevented against mainly includes internal and external environmental viruses.

Structurally, this embodiment has the following differences from embodiment 1.

Above all, there are differences in the structure of the one-piece protective suit 10.

First, the trousers 102 further include wear-resistant and anti-slip shoe covers 1021 connected to the bottom of the trouser legs. Here, the sole of the wear-resistant and anti-slip shoe covers 1021 have a thickness of 2-3.5 cm. By increasing the thickness of the sole of the shoe covers, the friction between the sole and the ground when walking outdoors is improved and no substantial wear will be sustained after one use, so as to achieve the effect of repeated use.

In one specific embodiment, the friction pattern is wavy with a depth of 0.2-0.5 cm. The friction pattern being a wavy pattern with a depth of 0.3 cm can get an optimal friction resistance with the ground, and the pattern is unlikely to be substantially worn in a single use after walking for a prolonged period, so as to achieve the repeated use.

In one specific embodiment, the friction pattern is circular-shaped with a depth of 0.15-0.4 cm. The friction pattern being circular-shaped with a depth of 0.3 m and a diameter of 2.5 cm can get an optimal friction resistance with the ground, and the pattern is unlikely to be substantially worn in a single use after walking for a prolonged period so as to achieve the repeated use.

Second, the knee and elbow positions of the trousers 102 and top 101 are covered with reflective fabrics 103 to ensure the safety of medical personnel to some extent. On one hand, the reflective fabric can improve the wear resistance of the quick-wearing parts. On the other hand, the reflective fabric can increase the safety factor of outdoor work at night. Even if the medical staff works outdoors, especially at night, the reflective fabric can reflect incident light and the reflected light helps others to locate the medical staff.

The methods to combine the reflective fabrics here include, but not limited to, glue bonding, thermoforming, and hook and loop fasteners and so on, as long as the surface of the one-piece protective suit 10 will not be damaged.

Third, the gloves are full-finger wear-resistant and non-slip gloves 1020. Compared with the half-finger gloves 1016 used in combination with medical protection gloves, the protective clothing in the embodiment is mainly used outdoors, while medical rubber gloves are prone to wear and damage and are not easily repairable. The full-finger wear-resistant anti-slip gloves 1020 have a rough surface and are not easy to be damaged. When picking up items outdoors, relative displacement is unlikely to happen.

Further, the full-finger wear-resistant and anti-slip gloves 1020 are provided with a number of friction particles, and the friction particles here may include, but not limited to, spherical shapes, which increase the roughness of the outer surfaces of the full-finger wear-resistant and anti-slip gloves 1020, thus prevents grabbed items from slipping off the wearer's grip.

Fourth, in this embodiment, the ankle position of the wear-resistant and anti-slip shoe covers 1021, the wrist and waist positions of the protective clothing are provided with hook and loop fasteners with their surface made of reflective material, so as to ensure the safety of field operations and tighten and fix the protective clothing.

Figure 10:
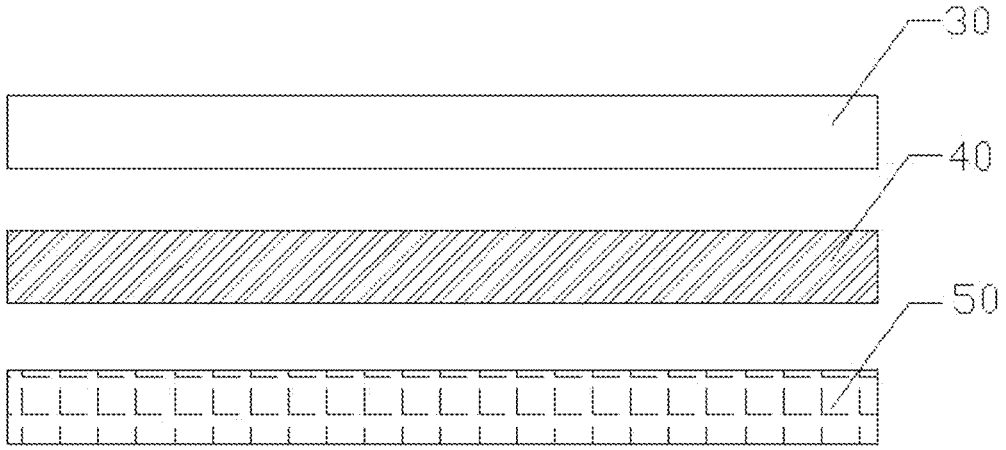
FIG. 10 is a schematic diagram showing the fabric layers of the material of the reusable protective clothing according to the first and second embodiment of the present disclosure.

With reference to FIG. 10, according to embodiment 2, the reusable protective clothing for epidemic prevention is made of a protective clothing material including a high-density woven fabric layer 30, a middle-layer fabric 40 and an outer-layer fabric 50 which are designed with a three-layer sandwich structure, and the inner layer is high-density woven fabrics that have good moisture permeability and tear resistance.

It should be noted that, for the sake of conciseness, the implementation principles and technical effects of this embodiment that are not mentioned in this embodiment can be understood by referring to the corresponding content in embodiment 1.

In summary, in combination with embodiment 1 and embodiment 2, the protective clothing of the present disclosure may include a one-piece protective clothing designed for epidemic prevention personnel and volunteers and a medical protective clothing designed for medical personnel. The one-piece protective clothing of the present disclosure can maximize prevention against exposure to pathogenic microorganisms in the wearing and the taking off process, the term "one-piece" reflects in the design that only the nose and mouth are accessible from the outside and the rest of the whole body is fully enclosed to form a closed loop. The protective clothing is lightweight and does not need any additional auxiliary device or means. Also, the protective clothing is able to be put on and taken off as a whole and thus the putting-on and taking-off can both be accomplished by a single act.

The medical protective clothing and the reusable protective clothing for epidemic prevention of the reusable protective clothing are both made of a material designed with a three-layer sandwich structure including a high-density woven fabric layer 30, a middle-layer fabric 40 and an outer-layer fabric 50.

Specifically, the material of the inner layer of the medical protective clothing described in embodiment 1 is a high-density woven fabric with good moisture permeability and tear resistance, the middle-layer fabric 40 is PTFE composite membrane that is light, thin, breathable, and can effectively isolate pathogens and withstand a temperature of 260° C. The outer-layer fabric 50 is a cotton cloth treated with chitosan molecules which have an antibacterial functionality and can withstand high-pressure disinfection. The material of the protective clothing is not only lightweight, and wear-resistant, but also has a degree of air permeability, and the fabric can withstand moist heat sterilization, namely, the material can be treated under 115° C.-121° C. for 15 min-30 min, and withstand more than 50 times of moist heat disinfection, so as to realize reuse of the protective clothing for multiple times and reduce the generation of medical waste, thus satisfying the requirement of having the ability to withstand the treatment of autoclave of hospital or laboratory to achieve repeated use.

The protective clothing for epidemic prevention described in embodiment 2 is different from the medical protective clothing described in the embodiment in that their materials have some differences. In embodiment 2, the middle-layer fabric 40 may comprise an organosilicon compound with good water resistance or fluorocarbon compound, and the outer-layer fabric 50 may be wear-resistant and oxidation-resistant polyester fiber, such material can satisfy the requirement of having the ability to withstand oxidative disinfection for repeated use. The material of the protective clothing is not only lightweight and wear-resistant, but also has a degree of air permeability. The protective clothing can withstand immersion in chlorine-containing disinfectant with a concentration of 1000 mg/l for 60 minutes, and more than 50 times of disinfection, thereby realizing reuse for multiple times and reducing the production of medical waste.

The high-density woven fabric mentioned above includes weft yarn of superfine composite fiber composed of 30% nylon and 70% polyester, and warp yarn composed of 70 D/72 ordinary polyester yarn. The woven high-density fabric shrinks by 40% in the weft direction to become a denser fabric, the inter-fiber pore size can be controlled at 7 μm, the monofilament fineness is less than 0.2 D, and the monofilament density can reach 68580/(2.54 cm)$^2$, the moisture vapor permeability is 5000-7000 g/m$^2$·24 h, the hydrostatic pressure resistance is 700 mm or more, and it has both warmth retention and elasticity properties.

The pathogen barrier effect of PTFE composite membrane described above will not be damaged even after being washed multiple times. As shown in the table below, according to the GB19082-2003 and WSB58-2003 standard, the protective clothing material containing PTFE composite membrane hasn't been washed and the protective clothing material containing PTFE composite membrane after 15 washes are compared by the following properties: filtration efficiency, synthetic blood penetration, airborne microbial barrier performance, liquid poliovirus barrier performance under natural pressure, and liquid poliovirus barrier performance under negative pressure.

| Test item | | protective clothing material | GB 19082-2003 Specified indicators | WSB 58-2003 Specified indicators |
|---|---|---|---|---|
| Filtration efficiency (%) | unwashed | >95 | ≥70% | — |
| | 15 washes | >95 | | |
| Synthetic blood penetration (pressure 13.8 kPa) | unwashed | qualified | Impermeable | — |
| | 15 washes | qualified | | |
| Airborne microbial barrier performance (%) | unwashed | >99 | — | >99 |
| | 15 washes | >99 | | |
| Liquid poliovirus barrier performance (%) (under atmospheric pressure) | unwashed | 100 | — | >99 |
| | 15 washes | >99 | | |
| Liquid poliovirus barrier performance (%) (under negative pressure) | unwashed | 100 | — | >99 |
| | 15 washes | >99 | | |

It can be learned from the table that whether the protective clothing material containing PTFE composite membrane hasn't been washed or has been washed 15 times, the properties of filtration efficiency, synthetic blood penetration, airborne microbial barrier performance, liquid poliovirus barrier performance under atmospheric pressure, and liquid poliovirus barrier performance under negative pressure are not changed.

Figure 11:
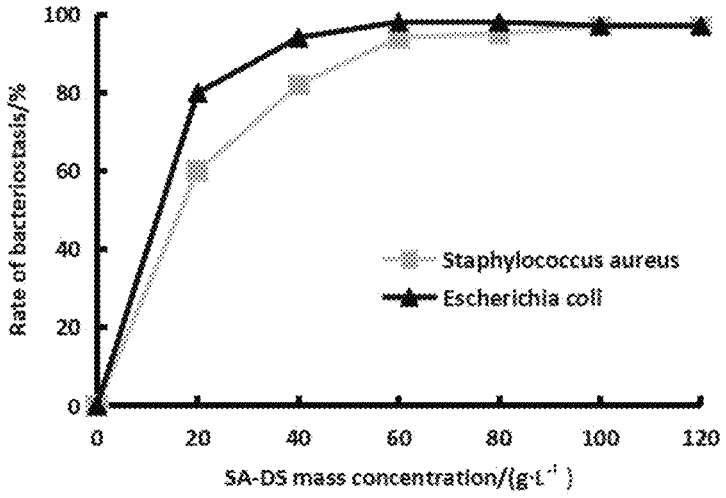
FIG. 11 shows the bacteriostatic effect of the medical protective clothing of the reusable protective clothing using chitosan antibacterial agent with different mass concentrations according to the first embodiment of the present disclosure.

Referring to FIG. 11, as the mass concentration of the chitosan antibacterial agent SA-50DS increases, the rate of bacteriostasis of the protective clothing textile of this embodiment also increases. The reason is that as the mass concentration of chitosan antibacterial agent SA-50DS increases, the amount of antibacterial agent bonded to the textile increases, so the antibacterial performance of the finished textile is better. When the mass concentration of chitosan antibacterial agent SA-50DS reaches 60 g/L, the rate of bacteriostasis of the finished textile is close to 100%.

Specifically, the polyester fiber is a knitted polyester fiber sample. Compared with the woven pure cotton sample, the woven polyester fiber sample and the knitted pure cotton sample, the knitted polyester fiber sample has the best wear resistance and oxidation resistance. The abrasion resistance of woven pure cotton sample, woven polyester fiber sample, knitted pure cotton sample, and knitted polyester fiber sample under dry and wet conditions is shown below.

| Sample | Abrasion cycle in dry state | Abrasion cycle in wet state |
|---|---|---|
| Woven pure cotton sample | 2050 | 1850 |
| Woven polyester fiber sample | 3900 | 3500 |
| Knitted pure cotton sample | 1850 | 1500 |
| Knitted polyester fiber sample | 3500 | 3300 |

It can be learned from the comparison that when compared to the woven pure cotton sample, the woven polyester fiber sample and the knitted pure cotton sample, the knitted polyester fiber sample with the polyester fiber can achieve the best wear resistance and oxidation resistance.

The above description merely includes preferred embodiments of the present disclosure, and is not intended to limit the present disclosure. For those skilled in the art, the present disclosure may have various modifications and changes. Any modification, equivalent replacement, improvement, and so on made within the spirit and principle of the present disclosure shall be included within the scope of protection of the present disclosure.

What is claimed is:

1. A reusable protective clothing comprising:

a one-piece protective suit including integrated top and trousers with attached gloves and shoe covers; and a protective headpiece having a face shield, wherein a front side of the protective headpiece is provided with a full-vision goggle with 180-degree field of view, the full-vision goggle is integrated with the face shield, a back side of the protective headpiece is provided with a protective hood made of a material of the one-piece protective suit, the protective hood is integrated with the top, the front side of the protective headpiece is provided with an air vent for a mouth and a nose configured according to facial features of a wearer, the air vent for the mouth and the nose is located at a position corresponding to the mouth and a bridge of the nose of a wearer, and an edge of the air vent is provided with a silicone sealing ring and a filter membrane, the filter membrane is fixed around the air vent via the silicone sealing ring and the silicone sealing ring fits with a shape of the wearer's face without leaving a gap; and an outer side of the protective headpiece is provided with ear-shaped hooks;

a width of an inner circumferential portion of the silicone sealing ring proximal to the air vent for the mouth and the nose and being in contact with an inner wall of the protective headpiece is greater than a width of an outer circumferential portion of the silicone sealing ring distal to the air vent for the mouth and the nose and being fit with the wearer's face; and an elastic belt is arranged along an edge around an outer contour of the filter membrane.

2. The reusable protective clothing according to claim 1, wherein the protective headpiece further comprises a latex band arranged inside the protective headpiece at two sides of the air vent for the mouth and the nose to assist the positioning of the air vent for the mouth and the nose.

3. The reusable protective clothing according to claim 1, wherein the protective headpiece further comprises a support ring arranged at a top part of the protective headpiece.

4. The reusable protective clothing according to claim 1, wherein the top comprises a back body covering piece and a front body covering piece, the protective hood is connected to a neck position of the back body covering piece and extends to the top part of the protective headpiece, and a first end of a waterproof zipper is arranged at a hip position at a back side of the trousers, a second end of the waterproof zipper extends through the back body covering piece to the top of the protective hood, and the waterproof zipper is covered with a flap.

5. The reusable protective clothing according to claim 1, wherein the gloves are full-finger wear-resistant anti-slip gloves.

6. The reusable protective clothing according to claim 1, wherein the gloves are half-finger gloves, and a wrist position of each half-finger glove is provided with nano tape.

7. The reusable protective clothing according to claim 1, wherein the shoe covers are provided at bottom positions of trouser legs and have wear-resistant and anti-slip property.

* * * * *